US012692642B2

(12) United States Patent
Huang et al.

(10) Patent No.: US 12,692,642 B2
(45) Date of Patent: Jul. 28, 2026

(54) NOZZLE STRUCTURE, DELIVERY APPARATUS AND WASHING MACHINE AND ADDITIVE DELIVERY METHOD

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Xuefeng Geng, Shandong (CN); Baozhen Cheng, Shandong (CN); Huacheng Zhang, Shandong (CN)

(73) Assignees: QINGDAO HAIER DRUM WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 365 days.

(21) Appl. No.: 18/257,400

(22) PCT Filed: Dec. 9, 2021

(86) PCT No.: PCT/CN2021/136754
§ 371 (c)(1),
(2) Date: Jun. 14, 2023

(87) PCT Pub. No.: WO2022/127684
PCT Pub. Date: Jun. 23, 2022

(65) Prior Publication Data

US 2024/0102227 A1 Mar. 28, 2024

(30) Foreign Application Priority Data

Dec. 14, 2020 (CN) ..... 202011472337.4
Dec. 14, 2020 (CN) ..... 202011475004.7

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 33/46* (2020.02);
(Continued)

(58) Field of Classification Search
None
See application file for complete search history.

(56) References Cited

U.S. PATENT DOCUMENTS

2012/0180534 A1* 7/2012 Cho ..... D06F 35/006 68/18 R
2013/0255329 A1* 10/2013 Leibman ..... D06F 33/37 68/17 R

FOREIGN PATENT DOCUMENTS

CN 102041664 A 5/2011
CN 107090697 A 8/2017
(Continued)

OTHER PUBLICATIONS

WO2018001160 A1, Drum Washing Machine and Washing Method, Shan (Year: 2018).*
(Continued)

*Primary Examiner* — Cristi J Tate-Sims
(74) *Attorney, Agent, or Firm* — Buchanan Ingersoll & Rooney PC

(57) ABSTRACT

A nozzle structure including a spray pipe, including an outlet end provided with a spray head formed with a spray outlet. The spray head is provided with a spray cavity and a flow channel, the spray cavity is connected with the spray outlet, the flow channel guides water inside the spray pipe to the spray cavity, the flow channel is connected with the spray
(Continued)

cavity through a connecting flow channel, and the connecting flow channel extends along a tangential direction of the spray cavity. A method for delivering additives to a washing machine is further provided, wherein after inlet water flow is mixed with delivered additives in a water supply path, a mixture is directly sprayed into a rotating washing drum.

11 Claims, 9 Drawing Sheets

(51) Int. Cl.

| | |
|---|---|
| ***D06F 33/46*** | (2020.01) |
| *D06F 105/02* | (2020.01) |
| *D06F 105/42* | (2020.01) |
| *D06F 105/48* | (2020.01) |

(52) U.S. Cl.
CPC ..... *D06F 2105/02* (2020.02); *D06F 2105/42* (2020.02); *D06F 2105/48* (2020.02)

(56) References Cited

FOREIGN PATENT DOCUMENTS

| | | | |
|---|---|---|---|
| CN | 107385799 | A | 11/2017 |
| CN | 111455630 | A | 7/2020 |
| CN | 212771554 | U | 3/2021 |
| KR | 20040105343 | A | 12/2004 |

OTHER PUBLICATIONS

International Search Report (PCT/ISA/210) with translation and Written Opinion (PCT/ISA/237) mailed on Mar. 15, 2022 by the China National Intellectual Property Administration (ISA/CN) as the International Searching Authority for International Application No. PCT/CN2021/136754. (11 pages).

* cited by examiner

NOZZLE STRUCTURE, DELIVERY APPARATUS AND WASHING MACHINE AND ADDITIVE DELIVERY METHOD

TECHNICAL FIELD

The present disclosure belongs to the technical field of clothes processing device, specifically relates to an additive delivery apparatus of a washing machine, in particular relates to a nozzle structure used for delivering an additive solution to a washing machine, and further relates to a washing machine installed with the above additive delivery apparatus and a method for delivering additives applied to the above washing machine.

BACKGROUND

The existing washing machines are generally provided with a water accommodating drum configured to accommodate washing water, the water accommodating drum is provided with a rotatable washing drum, the washing drum is formed with dehydration holes connecting the inside with the outside, such that washing water flowing into the water accommodating drum can flow interactively inside and outside the washing drum by utilizing dehydration holes, to achieve effects that washing water contacts with loads to be treated put in the washing drum and loads are treated by utilizing washing water.

The above method for delivering additives of the existing washing machine is as follows: through an additive delivery apparatus, additives are delivered into a pipe connected with a water accommodating drum of a washing machine, and then the delivered additives flow into the water accommodating drum of a washing machine along a pipeline. Therefore, additives delivered through the existing methods are placed inside the water accommodating drum and outside the washing drum of a washing machine, and additives cannot directly contact with loads put inside the washing drum.

Afterwards, when a washing machine executes a washing program, the delivered additives are mixed with washing water entering inside the water accommodating drum, part of the washing water mixed with additives flows into the washing drum via dehydration holes and contacts with loads to be treated in the drum, such that a small part of additives mixing in the washing water contact with loads and have an effect on the loads. Therefore, traditional methods for delivering additives have the problems of low efficiency in using additives and a waste of additives.

Meanwhile, in traditional methods for delivering additives, to ensure contact between additives delivered between the water accommodating drum and the washing drum and loads to be treated in the washing drum, a large amount of water needs to flow into the water accommodating drum, until a water level of washing water inside the water accommodating drum is higher than the washing drum, then it can be ensured that washing water flows into the washing drum via dehydration holes and additives can contact with loads in the washing drum. Therefore, traditional methods for delivering additives also have the problems of too much water used when additives are delivered.

Moreover, for the existing additive delivery apparatuses, a shell constituting a water box is generally arranged, the water box is connected in series onto a water inlet pipe of a washing machine; after additives to be delivered flow into the water box via a water path, when inlet water in a washing machine flows through the water box, additives to be delivered in the water box is flushed out, the flushed-out additives to be delivered flow inside the water accommodating drum and outside the washing drum together with inlet water, to achieve an object of delivering additives.

However, an additive delivery apparatus with the above structure has the following problems:

1. Additives need to be delivered after flowing through a water box, such that a delivering path of additives is increased, more additives remain in the delivering path, and the actual amount of delivered additives is reduced.
2. Additives are flushed into the water accommodating drum via inlet water which flows through the water box, since a cross section of the water box is greater than a cross section of a water path, the flow rate of water flow which flows through the water box will slow down, thereby easily leading to the problems that water flow which flows through cannot timely flush additives and additives remain in the water box.

In view of this, the present disclosure is hereby proposed.

SUMMARY

Technical problems to be solved in the present disclosure are to overcome shortcomings of the prior art, and provide a nozzle structure, to achieve an object of increasing cover area of spraying.

To achieve the above inventive object, basic concepts of technical solutions adopted in the present disclosure are as follows:

The present disclosure provides: a nozzle structure, including: a spray pipe, wherein an outlet end of the spray pipe is provided with a spray head, the spray head is formed with a spray outlet, the spray head is internally provided with a spray cavity and a flow channel, the spray cavity is connected with the spray outlet, the flow channel guides water inside the spray pipe to the spray cavity, the flow channel is connected with the spray cavity through a connecting flow channel, and the connecting flow channel extends along a tangential direction of the spray cavity, to increase tangential acceleration of water flow at the spray outlet, and further achieve a notable technical progress of increasing a cover area of water flowing from the nozzle structure.

Further, an adapter is arranged inside the spray head, the adapter is of a cylindrical structure with one end being open and the other end being enclosed, the open end is inserted relative to the spray outlet of the spray pipe, and the enclosed end and an end face of the spray head constitute a spray cavity;

and preferably, the adapter is clamped between the end face of the spray head and an outlet end of the spray pipe.

Further, a groove is arranged in the center of the enclosed end of the adapter, the groove and an end face of the spray head together enclose a spray cavity; the periphery of the enclosed end is provided with at least one notch, two ends of each notch are respectively connected with the flow channel and the spray cavity, and the notch constitutes the connecting flow channel which connects the flow channel with the spray cavity;

preferably, the periphery of the enclosed end of the adapter is relatively fit to an end face of the spray head;

and further preferably, an aperture of the connecting flow channel gradually narrows along a direction of water flow.

Further, the spray cavity is a cavity which gradually narrows from the periphery to the center, the end face of the spray head is provided with the spray outlet, the spray outlet is opposite to the center of the spray cavity and is formed along an axis;

preferably, a plurality of strip-shaped notches are distributed at equal intervals on the periphery of the spray cavity, each strip-shaped notch respectively extends along tangential directions of corresponding positions of the spray cavity, strip-shaped notches are distributed in symmetry relative to the center of a hemispheric spray cavity;

and further preferably, the spray outlet is arranged coaxially with the outlet end of the spray pipe and the cylindrical adapter.

Further, a side wall of the adapter is formed with through holes, and the flow channel is constituted by the inside of the adapter, the through holes, and a clearance between an outer side wall of the adapter and an inner side wall of the spray head; and preferably, through holes are formed on a side wall in the middle of the cylindrical adapter;

and further preferably, a circle of annular grooves are formed on an outer side wall in the middle of the cylindrical adapter, and a plurality of through holes are distributed at equal intervals in the annular grooves.

Further, the spray head includes an end cover, the spray outlet is arranged in the center of the end cover; the periphery of the end cover is provided with a circle of annular folded edges which are bent towards the side of the spray pipe and extend axially along the spray pipe, extending ends of the annular folded edges are in sealed connection with a water outlet end of the spray pipe, and a water outlet cavity is constituted inside the annular folded edges;

preferably, end parts of the annular folded edges are correspondingly fit to an end face of the outlet end of the spray pipe, and fitting parts are in sealed connection after being processed with a deposition technique;

and preferably, the spray outlet is a round hole with a radial dimension being less than an inner diameter of the spray pipe.

Further, the spray pipe is divided into a water inlet part, a bending part and a water outlet part in sequence along a direction of water flow, the water inlet part and the water outlet part are respectively a straight pipe extending along a straight line and a bending pipe with an axis of a bending part changing an extending direction; and a pipe diameter of the water inlet part is greater than the pipe diameter of the water outlet part.

Further, an outer wall of the water outlet part of the spray pipe is provided with at least one radially protruding plug-in installation rib.

Preferably, the outer wall of the water outlet part is provided with at least two plug-in installation ribs which respectively protrude radially and which are arranged in different sections.

Further preferably, the outer wall of the water inlet part is provided with a circle of radially protruding stopping ribs, and the stopping ribs are arranged at a position where the water inlet part is connected with the bending part.

After the above technical solutions are adopted, the nozzle structure of the present disclosure has the following beneficial effects:

through the above setting, vortex water flow is formed in the spray cavity, vortex water flow is sprayed out from the spray outlet, and a tangential speed of water flow in the nozzle structure flowing to the spray outlet can be improved, such that outlet water flow at the spray outlet is diffused towards the surrounding area, to achieve an effect that water flow flowing from the spray outlet of the nozzle structure is sprayed out in a conical and divergent shape, and further to achieve a notable technical progress of increasing a cover area of water flowing from the nozzle structure. More particularly, the above nozzle structure enables that a spray area of sprayed additive solution is increased, and further additive solution delivered by the additive delivery apparatus into the inner drum through the nozzle structure can fully contact with loads in the drum, and further a notable technical progress of improving a washing effect of a washing machine is achieved.

Still another object of the present disclosure is to provide an additive delivery apparatus, to achieve an object of delivering additives outwards directly via a water supply path.

To achieve the above inventive object, the following technical solutions are adopted:

an additive delivery apparatus of a washing machine includes a water supply path; and a delivery unit, configured to deliver additives to the water supply path; wherein an outlet of the water supply path is connected with the above nozzle structure.

In the present disclosure, through the above setting, additives are directly delivered outwards through a water path arranged on the delivery apparatus, additives are avoided from flowing through a water box, thereby not only reducing flowing routes of additives, but also reducing flushed water amount needed for delivering additives, and greatly improving utilization rate of additives. Meanwhile, an additive solution flowing from a water path is directly sprayed out via a nozzle, such that the cover area of sprayed additive solution is increased, and the additive solution can be directly sprayed onto loads to be treated at the depth of the inner drum.

Further, a water inlet part of the spray pipe of the nozzle structure is connected with an outlet of the water supply path, a water outlet end of the conduit is relatively inserted into and fixed with a water inlet part of the spray pipe, an end part of the conduit is limited by utilizing a circle of plug-in installation ribs which protrude radially on an outer wall of the water inlet part, to achieve insertion and positioning of the conduit and the spray pipe, thereby not only ensuring reliable insertion between the two, but also avoiding mutual separation between the two.

Another object of the present disclosure is to provide a washing machine installed with the above additive delivery apparatus, to achieve an object of directly delivering additives to the inner drum of a washing machine, and further achieve effects that delivered additives are in direct contact with loads to be treated in the inner drum and the utilization rate of detergent is improved.

To achieve the above inventive object, the following technical solutions are adopted:

a washing machine installed with the above additive delivery apparatus, including: an inner drum, a nozzle structure is installed at an opening of the inner drum, and a spray outlet of the nozzle structure is formed towards the inside of the inner drum.

In the present disclosure, through the above setting, in a washing machine installed with the above additive delivery apparatus, an additive solution formed when additives are mixed with a small amount of inlet water in a water supply path is directly sprayed onto loads to be treated in the inner drum, and further the utilization rate of delivered additives is dramatically improved.

Further, the inner drum is sleeved in the outer drum, the outer drum and the inner drum are arranged coaxially, and an opening is formed at the same side, the opening of the outer drum is connected with window pads which protrude and extend to the outside of the drum; the nozzle structure is arranged on the window pad, the spray pipe of the nozzle structure penetrates through the window pad, the spray head is arranged on an inner circumferential side of the window pad, and an axis of a water outlet part of the spray pipe is facing downwards in an inclined manner towards one side of the inside of the inner drum of a washing machine.

Further, the nozzle structure is arranged on the topmost part of the annular window pad; an axis of the water outlet part of the spray pipe and an axis of the inner drum are in the same plane, and an included angle between the axis of the water outlet part of the spray pipe and the axis of the inner drum is 20 degrees to 60 degrees.

Further, plug-in installation ribs arranged on an outer wall of the water outlet part of the spray pipe are abutted against two sides of the window pad respectively, such that the spray pipe is clamped on the window pad.

The present disclosure further provides a method for delivering additives, to achieve the objects that inlet water and additives are mixed uniformly and directly sprayed onto clothes to be washed in the washing drum.

To achieve the above inventive object, basic concepts of technical solutions adopted in the present disclosure are as follows:

the present disclosure provides a method for delivering additives to a washing machine, wherein after inlet water flow and the delivered additives are mixed in a water supply path, the mixture is directly sprayed into a rotating washing drum.

Further, specific steps of the additive delivery process are as follows:

step S1, delivering additives to a water supply path, until the delivering amount reaches a preset amount;

step S2, feeding water into the water supply path;

step S3, mixing inlet water and additives in the water supply path; and step S4, directly spraying the mixture into a washing drum, with the washing drum simultaneously rotating around an axis.

Further, when step S2 is executed, water is fed into the water supply path through the following specific forms:

step S21, feeding water into the water supply path continuously for a second set time t2, executing step S3 by utilizing inlet water this time to mix additives in the water supply path, to form an additive mixture; and step S22, feeding water into the water supply path continuously for a third set time t3, to flush out additive mixture in the water supply path;

preferably, before step S1 is executed, water is fed into the water supply path continuously for a first set time t1, to flush the water supply path.

Further, in the above process of delivering additives, water flow flows in the water supply path specifically as follows:

step S11, within a first set time t1, feeding water at a first set hydraulic pressure p1;

step S12, within a second set time t2, feeding water at a second set hydraulic pressure p2;

step S13, within a third set time t3, feeding water at a third set hydraulic pressure p3;

wherein p1 is greater than p2, p3 is greater than p2; and t1 is greater than t2, and t3 is greater than t2.

Further, when step S2 is executed, water flow flowing in the water supply path operates alternatively through the following steps:

step S121, within a first set time period t21, closing the water inlet of the water supply path, wherein inlet water flow no longer flows through the water supply path; and step S122, within a second set time period t22, opening the water inlet of the water supply path, wherein inlet water flow flows through the water supply path;

further, the process of delivering additives is divided into a plurality of delivery units, and each delivery unit is executed in sequence according to the above step S1 to step S4;

preferably, the spacing time between adjacent delivery units is T2, the total time for each delivery unit to execute the above step S1 to step S4 is T1, and T2 is not less than T1;

further preferably, within the spacing time T2, the washing drum rotates around an axis at a set rotating speed V2.

Further, in each delivery unit, the delivering amount of additives is not greater than the maximum set amount M.

Further, when step S3 is executed, a stirring motor in the water supply path drives a stirring impeller to rotate, to stir the mixture of inlet water which flows through and additives, so as to improve mixing uniformity of the mixture.

Further, when step S2 to step S4 are executed, the mixture is sprayed into the washing drum from an opening of the washing drum, and the washing drum rotates at a set rotating speed V1;

preferably, when step S3 is executed, the washing drum rotates at a first set rotating speed V11; when step S4 is executed, the washing drum rotates at a second set rotating speed V12; and V12 is greater than or equal to V11;

further preferably, before step S1 is executed and at the first set time t1 at which water is fed into the water supply path, the washing drum rotates at a set rotating speed V2, and V2 is greater than V11.

The present disclosure further provides a washing machine using the above method for delivering additives, including: an additive delivery apparatus provided with a water supply path for water to flow through, and a delivery structure configured to deliver additives to the water supply path; wherein an outlet of the water supply path is connected with a nozzle, and the nozzle is arranged towards the inside of the washing drum of the washing machine, to spray the mixture of additives and water into the washing drum.

Further, a turbulence structure is arranged in the water supply path, to form vortex water flow in the water supply path, and mix the delivered additives and inlet water.

After the above technical solutions are adopted, the present disclosure has the following beneficial effects as compared with the prior art:

through the above control method, an additive mixture is directly sprayed uniformly onto clothes inside the washing drum, then clothes to be washed are directly sprayed to be wet by the mixture, thereby not only reducing water consumption during a washing process, but also enabling additives to be directly distributed on clothes, improving use efficiency of additives, and reducing loss of additives.

Meanwhile, the present disclosure is simple in structure, notable in effects, and suitable for application and use.

Specific implementations of the present disclosure will be further described in details below in combination with accompanying drawings.

BRIEF DESCRIPTION OF THE DRAWINGS

As a part of the present disclosure, the accompanying drawings are provided to facilitate further understanding of the present disclosure, illustrative embodiments and descriptions thereof in the present disclosure are used for explaining the present disclosure, rather than constituting an improper limit to the present disclosure. Apparently, the accompanying drawings described below are merely some embodiments. Those skilled in the art can obtain other accompanying drawings according to these drawings without any creative effort. In the accompanying drawings.

Main elements in the figures.

Figure 1:
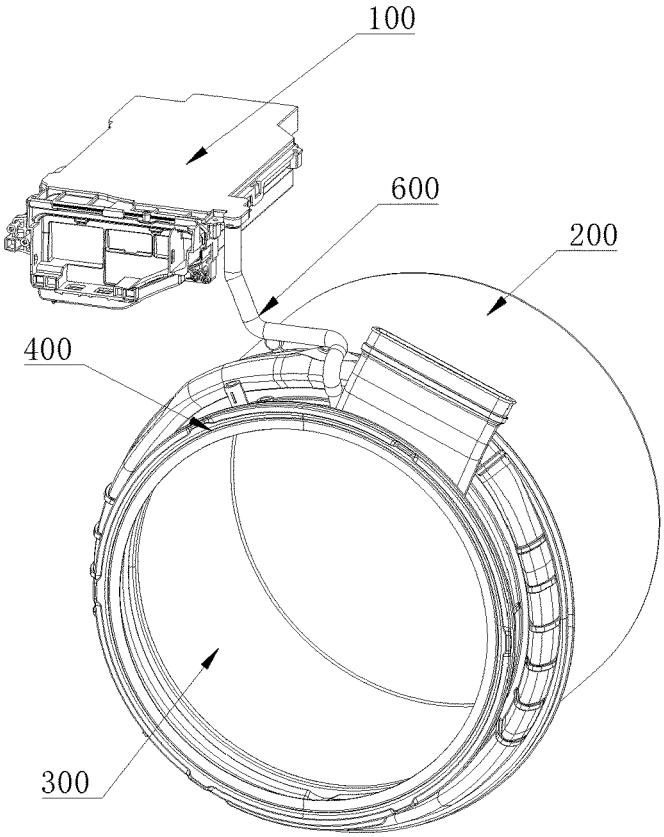
FIG. 1 to FIG. 3 are structural schematic diagrams of different perspectives of a washing machine in embodiments of the present disclosure.
Figure 2:
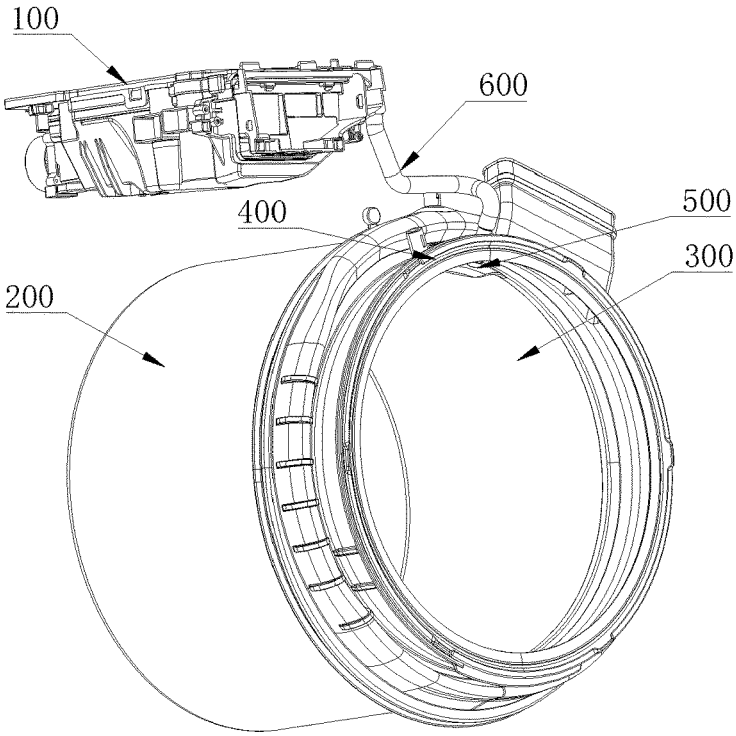
Figure 3:
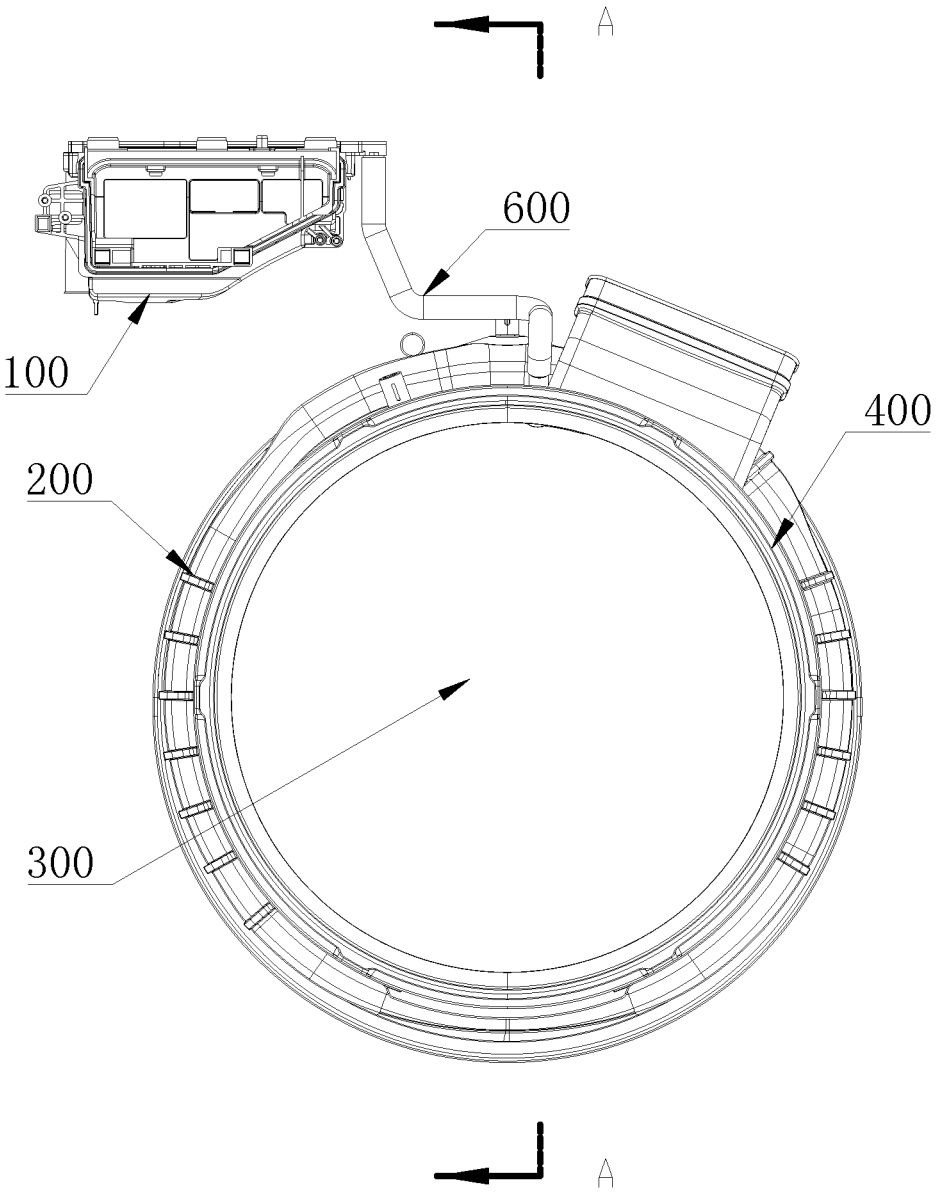
Figure 4:
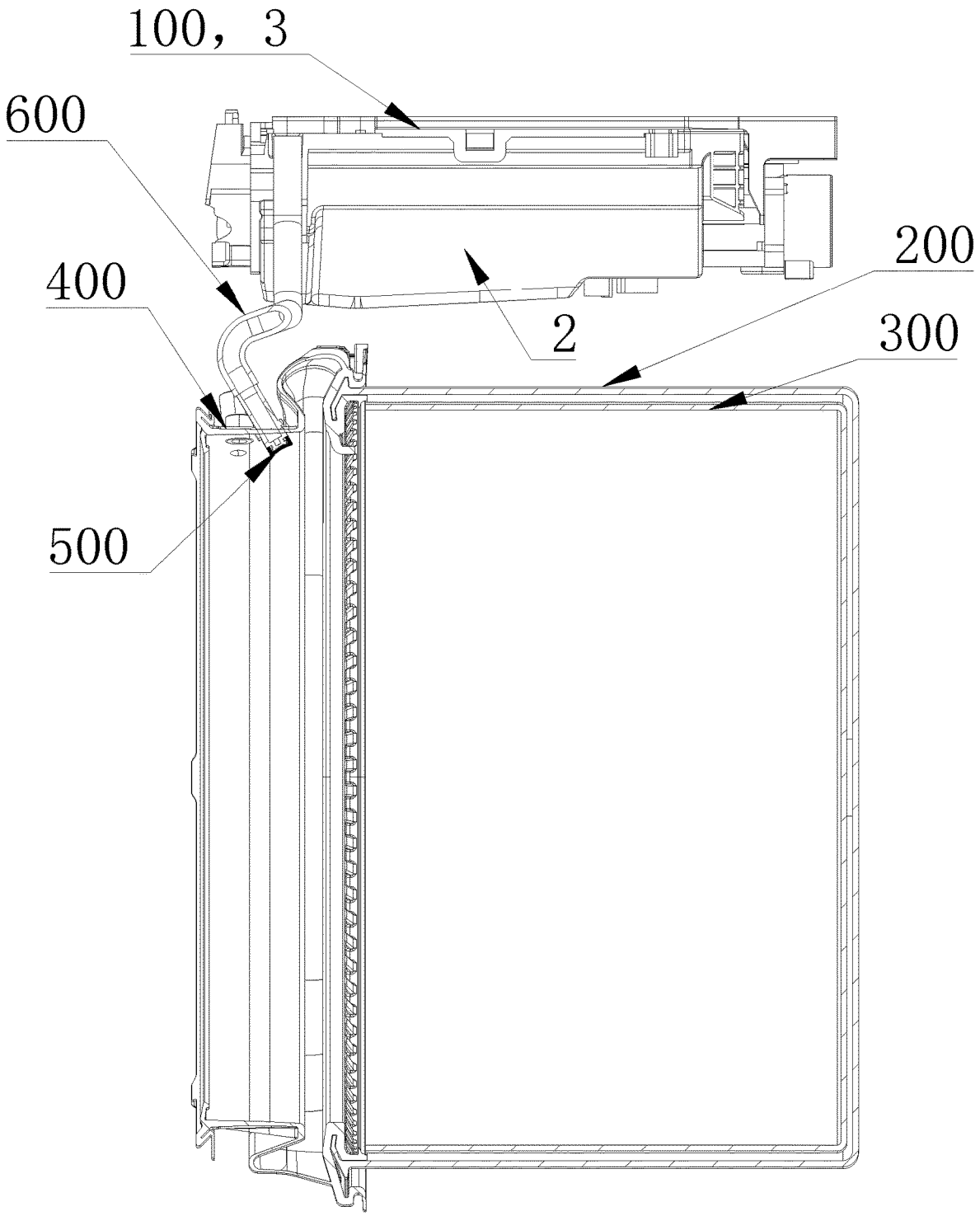
FIG. 4 is a structural schematic diagram of an A-A cross section in FIG. 3 in embodiments of the present disclosure.
Figure 5:
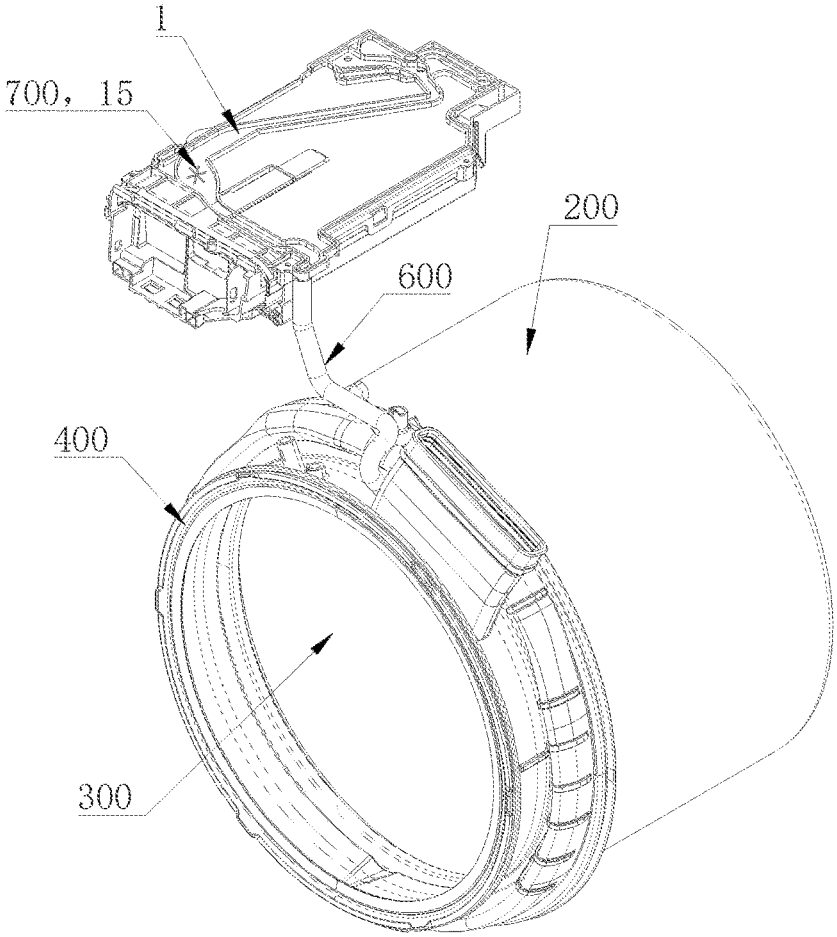
FIG. 5 is a structural schematic diagram of a washing machine after a first part of an upper cover is removed in embodiments of the present disclosure.

100, delivery apparatus; 200, water accommodating drum; 300, washing drum; 400, window pad; 500, nozzle; 600, conduit; 700, turbulence structure; 1, water supply path; 2, shell; 3, upper cover; 31, first part; 32, second part; 4, liquid storage cavity; 5, liquid storage box; 6, pump; 7, communicating vessel; 8, liquid pumping flow channel; 11, outlet; 12, inlet; 13, liquid suction opening; 15, impeller; 16, mixing part; 17, central axis; 18, fan blade; 81, inlet; 82, outlet.

It should be noted that, these accompanying drawings and text description do not aim at limiting the conceptive scope of the present disclosure in any form, but to illustrate concepts of the present disclosure for those skilled in the art with reference to specific embodiments.

DETAILED DESCRIPTION OF THE EMBODIMENTS

In order to make objects, technical solutions and advantages of the embodiments of the present disclosure clearer, a clear and complete description will be given below on the technical solutions in the embodiments in combination with accompanying drawings in the embodiments of the present disclosure, and the following embodiments are used for illustrating the present disclosure, rather than limiting the scope of the present disclosure.

In the description of the present disclosure, it should be noted that, the orientation or positional relationship indicated by such terms as "up", "down", "front", "rear", "left", "right", "vertical", "inner" and "outer" is the orientation or positional relationship based on the accompanying drawings. Such terms are merely for the convenience of description of the present disclosure and simplified description, rather than indicating or implying that the device or element referred to must be located in a certain orientation or must be constructed or operated in a certain orientation, therefore, the terms cannot be understood as a limitation to the present disclosure.

In the description of the present disclosure, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection or can be indirect connection through an intermediate. For those skilled in the art, specific meanings of the above terms in the present disclosure can be understood according to specific conditions.

As shown in FIG. 1 to FIG. 9, embodiments of the present disclosure further introduce a washing machine, including: a water accommodating drum 200 configured to accommodate water, the water accommodating drum 200 is internally installed with a rotatable washing drum 300 configured to accommodate loads to be treated and an additive delivery apparatus 100 configured to directly deliver additives to the inside of the washing drum 300. Through the above setting, a washing machine can achieve using effects that additives can be directly delivered into the washing drum 300, and the delivered additives can be directly sprayed onto loads to be treated in the washing drum 300, and further a notable technical progress of improving utilization rate of additives is achieved.

As shown in FIG. 1 to FIG. 9, the additive delivery apparatus 100 in the embodiments of the present disclosure includes:

- a water supply path 1, configured to allow inlet water entering into the additive delivery apparatus 100 to flow through;
- a delivery structure, configured to deliver additives to the water supply path 1;
- a nozzle 500, wherein an outlet 11 of the water supply path 1 is connected with the nozzle 500, and the nozzle 500 is arranged towards the inside of the washing drum 300 of a washing machine. When additives are delivered, a small amount of inlet water flows into the water supply path, such that additives are mixed with a small amount of inlet water in the water supply path 1 to form an additive solution, the additive solution supplied by the water supply path 1 can be directly sprayed onto loads to be treated in the washing drum 300 via a nozzle 500, and further the utilization rate of delivered additives is dramatically improved.

Through the above setting, additives are directly delivered outwards through a water path arranged on the delivery apparatus 100, additives are avoided from flowing through a water box, thereby not only reducing routes through which additives flow, but also reducing the amount of flushed water needed for delivering additives, and greatly improving utilization rate of additives.

As shown in FIG. 1 to FIG. 9, in embodiments of the present disclosure, the water supply path 1 is integrated on the shell 2 of the additive delivery apparatus 100, an outlet 11 of the water supply path 1 is arranged on an outer side of the shell 2, the nozzle 500 is arranged outside the shell 2, and an outlet 11 of the water supply path 1 is communicated with the nozzle 500 through a conduit 600. Through a water supply path 1 integrated on the shell 2 of the additive delivery apparatus 100, an outlet 11 of the water supply path 1 is directly communicated with the nozzle 500, such that additives and inlet water pumped out through the water supply path 1 are sprayed out jointly, and further the object that the additive delivery apparatus 100 is directly sprayed outwards and delivered through the nozzle 500 without passing through a water box of the delivery apparatus 100 is achieved.

Embodiments of the present disclosure provide a method for delivering additives to a washing machine, after inlet water flow is mixed with delivered additives in the water supply path, and the mixture is directly sprayed into a rotating washing drum.

Through the above control method, an additive mixture is directly sprayed uniformly onto clothes inside the washing drum, then clothes to be washed are directly sprayed to be wet by the mixture, thereby not only reducing water consumption during a washing process, but also enabling additives to be directly distributed on clothes, improving use efficiency of additives, and reducing loss of additives.

Embodiment 1

The present embodiment introduces a method for delivering additives to a washing machine, wherein after inlet water flow is mixed with the delivered additives in a water supply path, a mixture is directly sprayed into a rotating washing drum.

Figure 10:
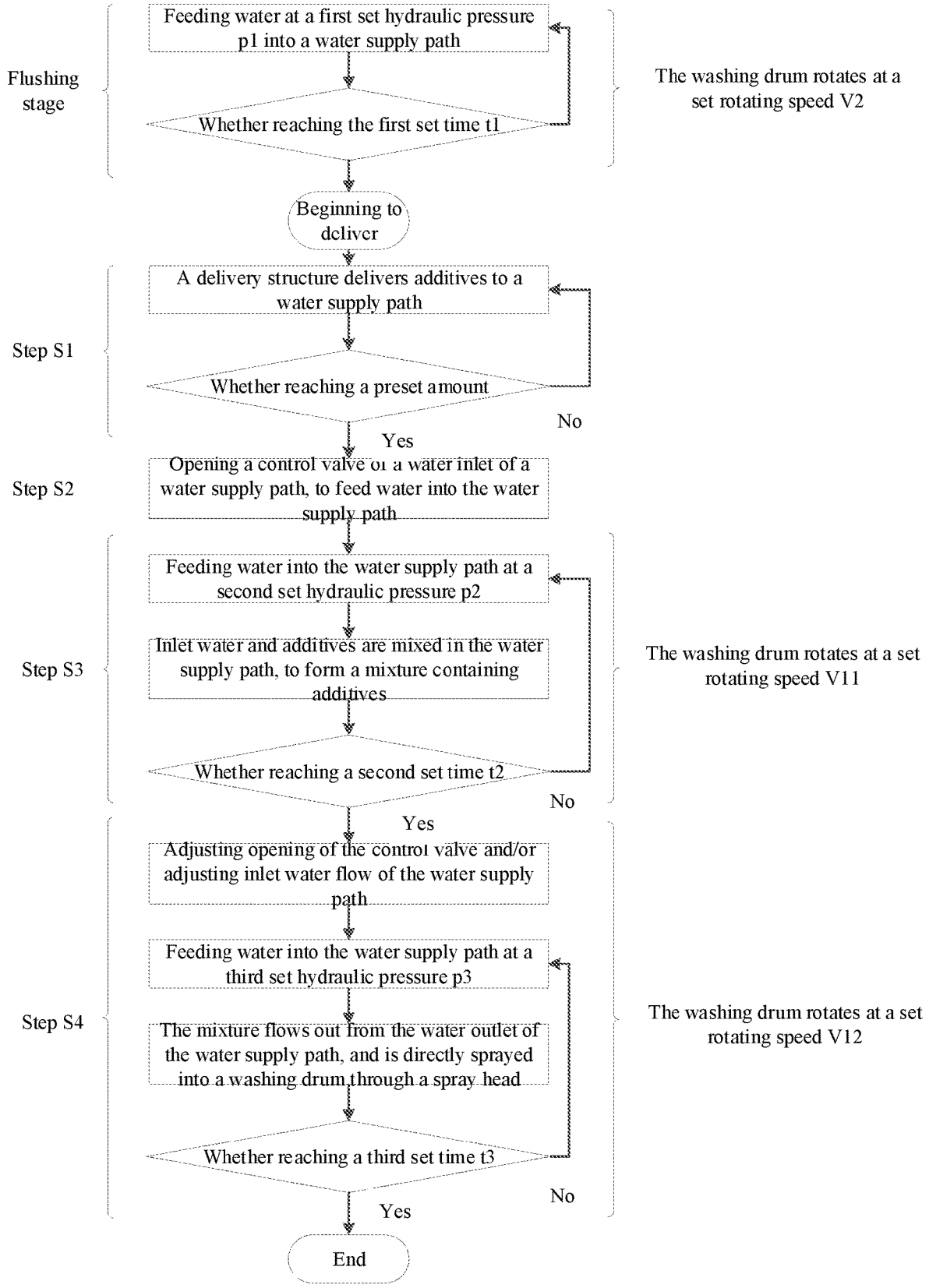
FIG. 10 is a control logic diagram of an additive delivery method in embodiments of the present disclosure.

As shown in FIG. 10, specific steps of delivering additives are as follows:

- step S1, within a set time t, delivering, by a delivery structure, additives to a water supply path, until the delivery amount reaches a preset amount;
- step S2, opening a control valve at a water inlet of the water supply path, and feeding water to the water supply path;
- step S3, within a second set time t2, feeding water into the water supply path at a second set hydraulic pressure p2, mixing inlet water and additives in the water supply path, to form a mixture containing additives; and
- step S4, adjusting opening of the control valve and/or adjusting inlet water flow of the water supply path, within a third set time t3, feeding water at a third set hydraulic pressure p3, wherein the mixture flows out from the water outlet of the water supply path, and is directly sprayed into a washing drum through a spray head; and the washing drum simultaneously rotates around an axis, such that the mixture is uniformly sprayed onto clothes in the washing drum.

Through the above control method, an additive mixture is directly sprayed uniformly onto clothes inside the washing drum, then clothes to be washed are directly sprayed to be wet by the mixture, thereby not only reducing water consumption during a washing process, but also enabling additives to be directly distributed on clothes, improving use efficiency of additives, and reducing loss of additives.

In the present embodiment, p3 is greater than p2; and t3 is greater than t2. Further, in the process of delivering additives, inlet water hydraulic pressure of the water supply path is firstly reduced, such that retention time of additives in the water supply path is shorter, and additives and inlet water are sufficiently mixed uniformly; afterwards, after additives are mixed, inlet water at a greater pressure is fed into the water supply path, such that the mixture is driven by high-pressure inlet water to be sprayed into the washing drum at a greater cover area, the cover area of additives in the washing drum is increased, and further mixing uniformity of clothes and additives is improved.

In the present embodiment, before step S1 is executed, water is fed into the water supply path at a first set hydraulic pressure p1 for a first set time t1, and water inside the water supply path is flushed. The p1 is greater than p2; and t1 is greater than t2. Through the above setting, before additives are delivered, inlet water at a larger hydraulic pressure is fed into the water supply path, such that additives remained in the water supply path are flushed away, to reduce obstacles to the mixing of put additives.

In the present embodiment, when step S4 is executed, the mixture is sprayed into the washing drum from the opening of the washing drum, and the washing drum rotates at a set rotating speed V1.

In the present embodiment, in the process of executing step S2 to step S4, the washing drum rotates around an axis at a set rotating speed, to stir clothes inside the washing drum, and uniformly spray the additive mixture to each part of clothes inside the drum.

As shown in FIG. 10, in the process of delivering additives, the washing drum rotates specifically as follows:

- when step S3 is executed at a second set time period t2, the washing drum rotates at a set rotating speed V11;
- when step S4 is executed at a third set time period t3, the washing drum rotates at a set rotating speed V12;
- before step S1 is executed and at the first set time t1 when water is fed into the water supply path, the washing drum rotates at a set rotating speed V2;
- V12 is greater than or equal to V11, and V2 is greater than V11.

Embodiment 2

Based on the above Embodiment 1, the present embodiment further has the following technical features:

- when the above step S2 to step S4 of the above Embodiment 1 are executed, water flow flowing in the water supply path operates alternatively through the following steps:
- step S121, within a first set time period t21, closing a control valve of a water inlet of the water supply path, wherein inlet water flow no longer flows through the water supply path; and
- step S122, within a second set time period t22, opening the control valve of the water inlet of the water supply path, wherein inlet water flow at a second set hydraulic pressure p2 flows through the water supply path.

Through controlling spaced opening and closing of a water supply path in a process of delivering additives, additives are mixed with a spacing water flow which flows through the water supply path, retention time of additives in the water supply path is further extended, mixing uniformity between additives and inlet water flow in the water supply path is improved, and further the mixing uniformity between delivered additives and inlet water is effectively improved.

In the present embodiment, when step S3 and step S4 are executed, the ratio of t21 to t22 is different, to achieve an effect of correspondingly adjusting inlet water hydraulic pressure of the water supply path through changing the time at which a control valve of a water inlet of a water supply path is opened and closed. Preferably, when step S3 is executed, the ratio of t21 to t22 is n1, and when step S4 is executed, the ratio of t21 to t22 is n2, and n1 is greater than n2.

Embodiment 3

Based on the above Embodiment 1 and Embodiment 2, the present embodiment further has the following technical features:

in the present embodiment, the additive delivery process is divided into multiple delivery units, and the delivery units are executed in sequence according to the above step S1 to step S4.

In the present embodiment, the spacing time between adjacent delivery units is T2, the total time for each delivery unit to execute the above step S1 to step S4 is T1, such that additives are delivered step by step, clothes in the washing drum are at different states when additives execute the delivery unit each time, and further the additive mixture uniformly contacts with each part of clothes inside the washing drum. Preferably, T2 is not less than T1, such that sufficient spacing time is kept between each delivery unit, to prevent interference during delivering.

In the present embodiment, within a spacing time t2, the washing drum still rotates around an axis at a set rotating speed V2, to stir clothes inside the washing drum, and further ensure uniform distribution of clothes inside the washing drum and improve contact uniformity between additives and clothes.

In the present embodiment, in each delivery unit, the delivery amount of additives is not greater than the maximum delivery amount M; preferably, in each delivery unit, the delivery amount of additives can be set to be unequal or equal.

Figure 11:
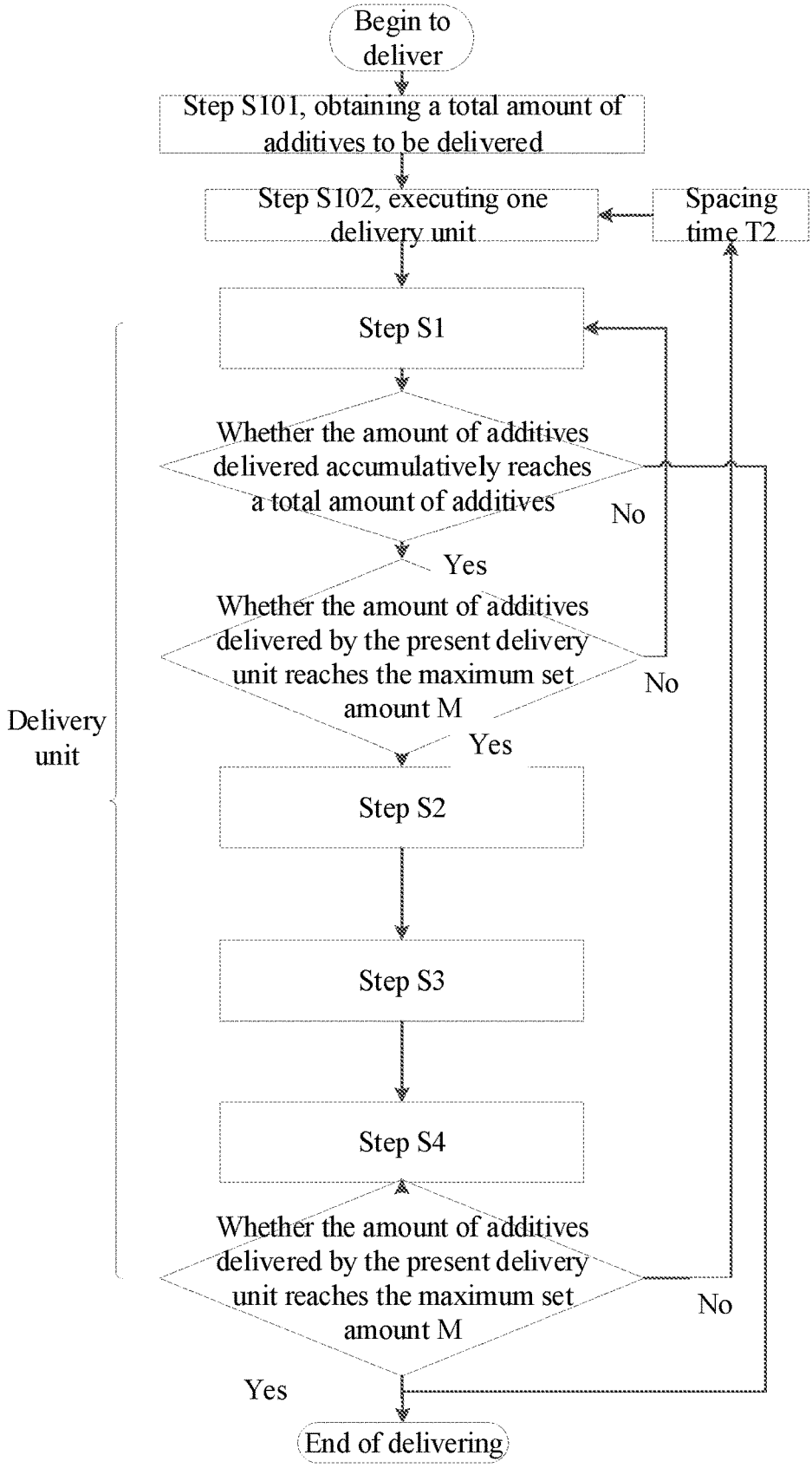
FIG. 11 is a control logic diagram of additive delivery amount in embodiments of the present disclosure.

For example, as shown in FIG. 11, in the process of delivering additives, the method for calculating delivery amount is specifically as follows:

step S101, before a washing machine runs programs, obtaining a total amount of additives to be delivered;

step S102, executing one delivery unit according to the above step S1 to step S4;

step S103, when step S1 of the delivery unit is executed, judging in real time whether the amount of additives delivered accumulatively reaches a total amount of additives, if so, then stopping delivering; otherwise, continuing to deliver;

step S104, when step S1 of the delivery unit is executed, judging in real time simultaneously whether the amount of additives delivered by the present delivery unit reaches the maximum set amount M, if so, then stopping delivering; otherwise, continuing to deliver; and step S105, after the present delivery unit is finished, judging whether the amount of additives delivered accumulatively reaches the total amount of additives, if so, finishing delivering; otherwise, after the spacing set time t, performing step S102 again, and performing the delivery unit again.

Embodiment 4

As shown in FIG. 1 to FIG. 8, in embodiments of the present disclosure, a turbulence structure 700 is arranged in the water supply path 1 of the additive delivery apparatus, to form vortex water flow in the water supply path 1, and mix delivered additives and inlet water; and a nozzle 500 is further arranged in the water supply path 1, an outlet of the water supply path 1 is connected with the nozzle 500, to deliver mixed additives and water.

Through setting a turbulence structure in the water supply path, the mixture of additives and water in the water supply path will form a vortex water flow while flowing through the turbulence structure, to stir additives and water to mix, and further to achieve a notable technical progress of improving mixing uniformity of additive solution flowing out from the water supply path of the additive delivery apparatus.

Figure 9:
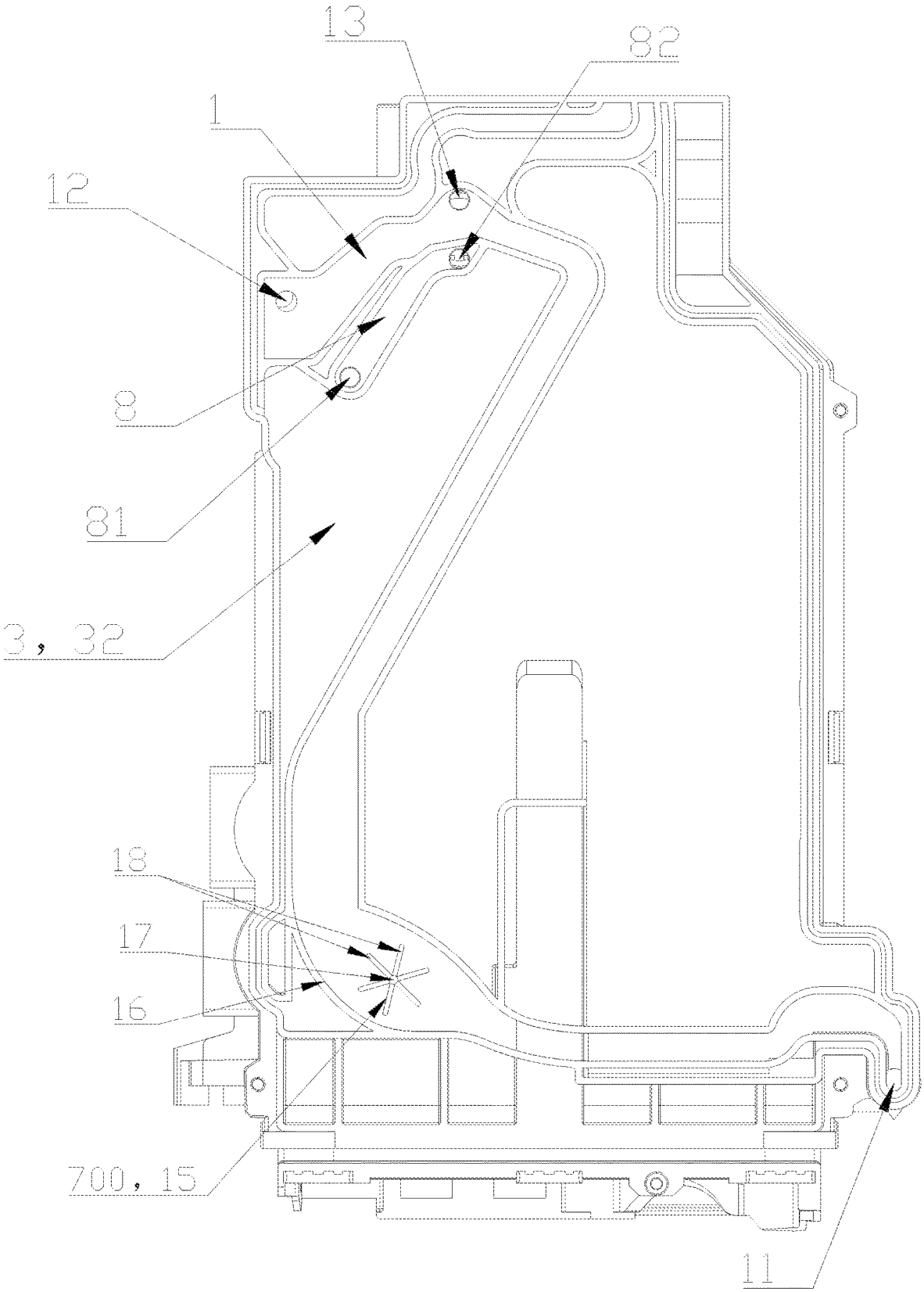
FIG. 9 is a structural schematic diagram of a top view of an additive delivery apparatus after a first part of an upper cover is removed in embodiments of the present disclosure.

As shown in FIG. 9, in the present embodiment, the turbulence structure 700 includes an impeller 115 which can rotate around the central axis and which is arranged in the water supply path 1, and the central axis 17 of the impeller 15 is vertical to a flowing direction of a mixture of additives and water in the water supply path 1. In the present embodiment, the impeller 15 includes a central axis 17, at least one end of the central axis 17 is connected with the water supply path 1 in a manner of rotating around an axis, a plurality of fan blades 18 are distributed at intervals on the periphery of the central axis 17, each fan blade 18 extends along different radial directions of the central axis 17, the fan blades 18 are distributed in symmetry relative to the central axis 17, and an extending length of the fan blade 18 along a radial direction of the central axis 17 is less than a spacing between the central axis 17 and an inner wall of the water supply path 1.

In the present embodiment, a central axis of the impeller 15 is directly connected with a driving motor or is indirectly connected with a driving motor via a transmission structure, and the driving motor is configured to drive the impeller to rotate around the central axis, such that the impeller is driven by the driving motor to rotate actively.

In the process of delivering additives, when step S3 in the above embodiments is executed, a stirring motor in the water supply path drives a stirring impeller to rotate, to stir the mixture of flowing inlet water and additives, so as to improve mixing uniformity of the mixture.

Of course, in the present embodiment, the turbulence structure 700 can also be arranged to be any other existing structure or a combination of structures capable of stirring water flow in the water path, for example, collision ribs, turbulence ribs and diversion ribs which are arranged in a protruding manner in the water path.

As shown in FIG. 9, in the present embodiment, a water supply path 1 of the additive delivery apparatus is provided with a liquid suction opening 13 connected with the delivery structure and allowing additives to flow into, the turbulence structure 700 is arranged in the water supply path 1 downstream of the liquid suction opening 13, such that an object on which the turbulence structure 700 has an effect is a mixture of additives and inlet water, to achieve an effect of improving balancing uniformity of additives and inlet water of the mixture sprayed by the additive delivery apparatus.

As shown in FIG. 9, in the present embodiment, the liquid suction opening 13 is arranged to be close to an inlet 12 of the water supply path 1, such that the mixture of additives and inlet water can flow through most of the water supply path 1, to effectively utilize length of the water supply path 1 to mix the mixture, and to further effectively improve mixing uniformity.

As shown in FIG. 9, in the present embodiment, a mixing part 16 with an increased cross-sectional area is arranged in the middle of the water supply path 1, and the turbulence structure 700 is arranged in the mixing part 16. Through setting a mixing part with an increased cross section in a water supply path, the flow rate of the mixture which flows through the mixing part slows down, the contact time between the mixture and the turbulence structure is extended, and further the mixed effect of the mixture by the turbulence structure is improved.

As shown in FIG. 9, in the present embodiment, the mixing part 16 is a channel with a cross-sectional area being gradually enlarged from two ends to the middle part, and at least part of the turbulence structure 700 is arranged at the maximum cross-sectional area of the mixing part 16, to further improve the mixed effect. Preferably, openings at two ends of the mixing part 16 face towards different directions, to further slow down flow rate of water flow which flows through the mixing part, and improve the mixed effect of additives and inlet water.

As shown in FIG. 9, in the present embodiment, the turbulence structure 700 is arranged at an axis or in the middle adjacent to the axis of the mixing part 16, a spacing exists between the turbulence structure 700 and the left and right side walls of the mixing part 16, to increase a cover range of the turbulence structure 700 on the mixture which flows through, and further to improve mixed uniformity.

Embodiment 5

Figure 7:
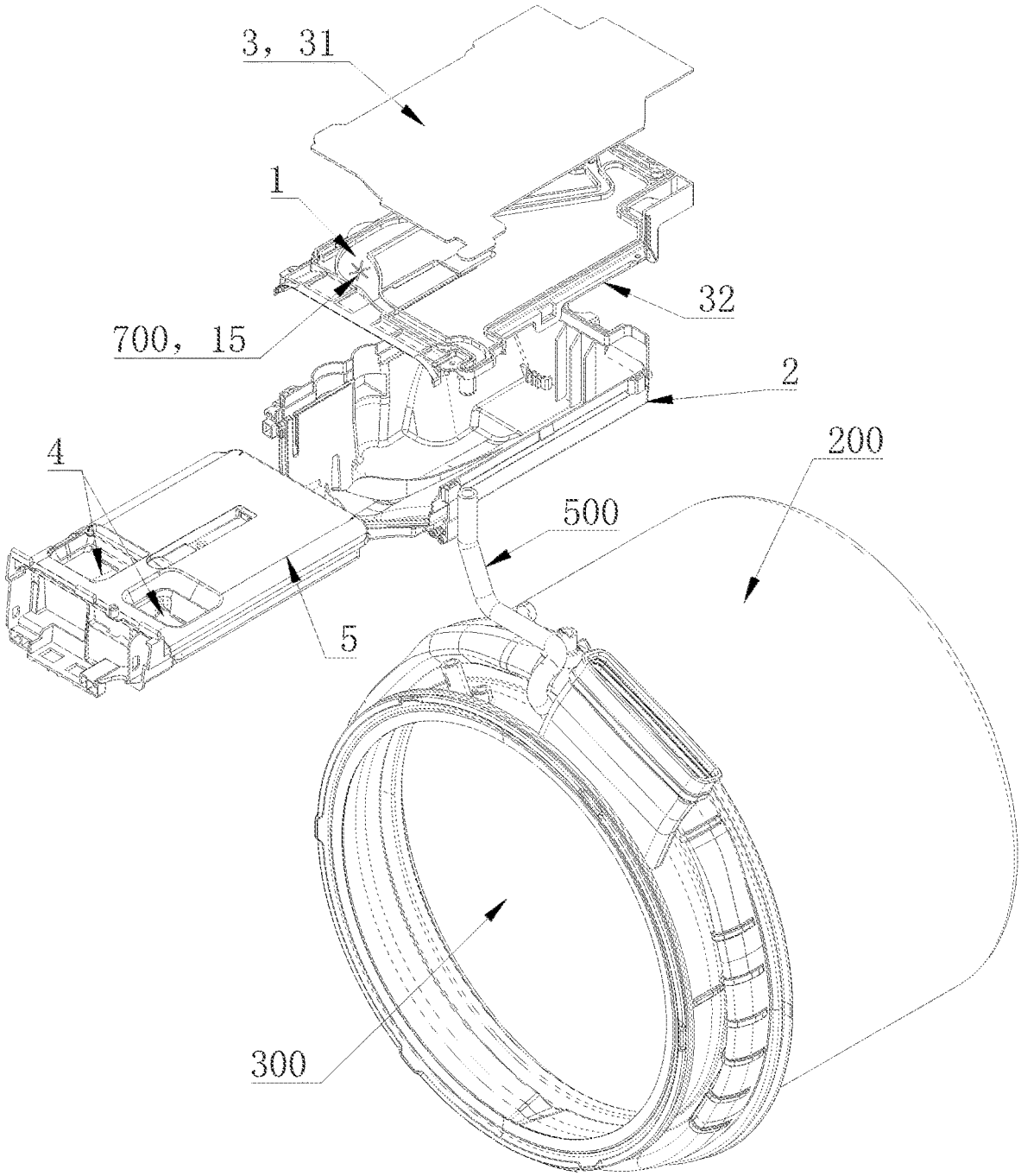
FIG. 7 and FIG. 8 are structural schematic diagram of a washing machine after an additive delivery apparatus is exploded in embodiments of the present disclosure.
Figure 8:
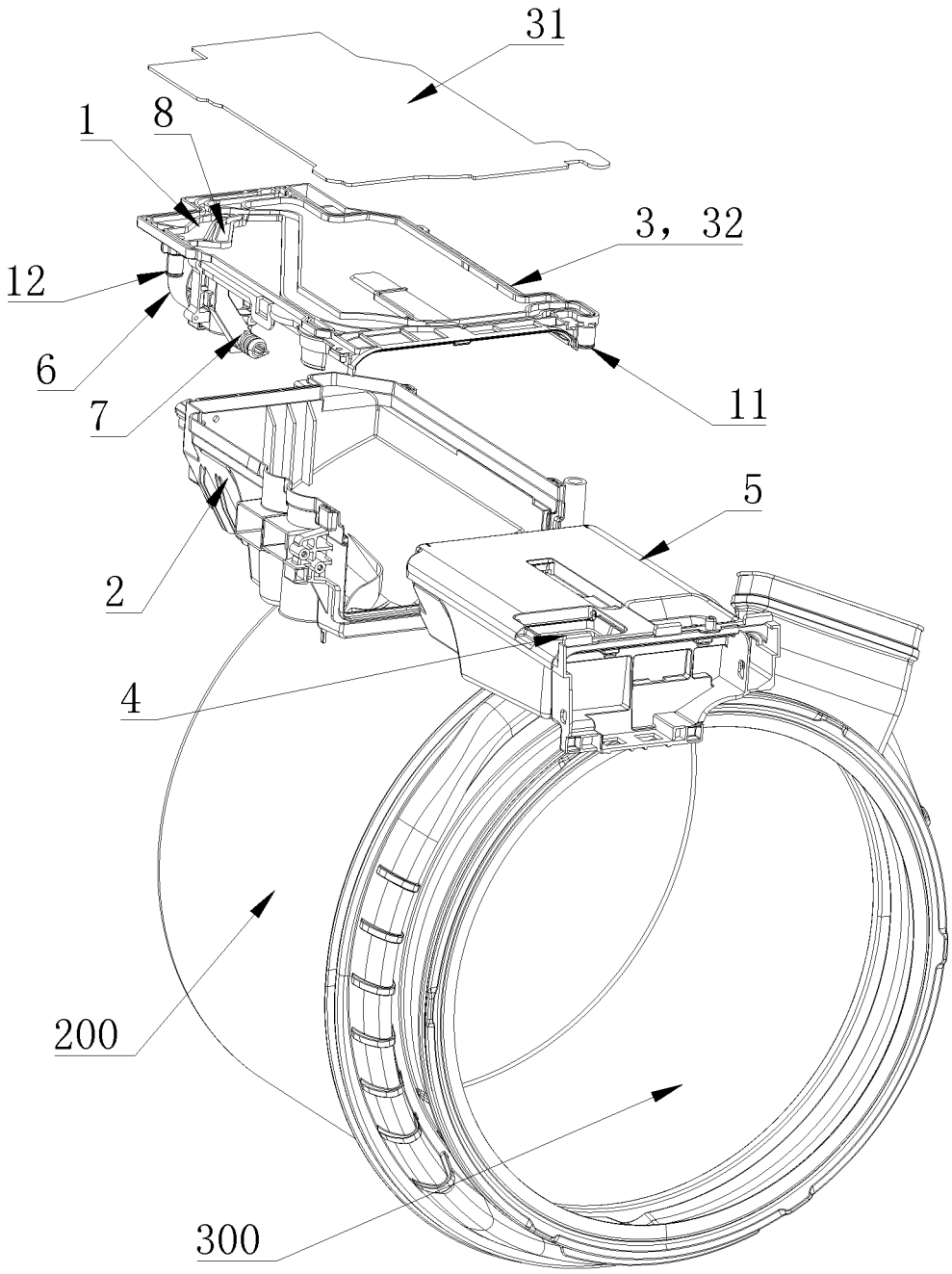

Based on the above embodiments, the present embodiment further has the following technical features:

as shown in FIG. 7 and FIG. 8, in the present embodiment, a top part of a shell 2 of an additive delivery apparatus 100 is an upper cover 3, a water supply path 1 is arranged inside the upper cover 3, an outlet 11 of the water supply path 1 is exposed on an outer circumferential side of the upper cover 3, an inlet end of a conduit 600 is communicated with an outlet 11 of the water supply path 1, and an outlet end of the conduit 600 is communicated with a nozzle 500 outside the shell 2. Preferably, the upper cover 3 includes a first part 31 and a second part 32 which are buckled up and down, the first part 31 and the second part 32 are relatively spliced, and the water supply path 1 is formed at a connecting surface. Further preferably, the first part 31 and the second part 32 of the upper cover 3 are connected through a deposition technique, to form an enclosed water path structure which can bear pressure inside.

Further, the water supply path 1 of the additive delivery apparatus 100 is integrated on the upper cover 3, such that inlet water and additives of the delivery apparatus 100 are directly delivered through the water supply path 1 inside the upper cover 3, to further achieve an effect that additives directly flow out from an outlet 11 on the outer circumferential side of the upper cover 3 for delivering.

In the present embodiment, the delivery structure includes a liquid storage cavity 4 configured to store additives, and the liquid storage cavity 4 is connected with the water supply path 1; and the delivery apparatus 100 is further provided with a power unit, to provide power to pump additives in the liquid storage cavity 4 into the water supply path.

As shown in FIG. 1 to FIG. 8, in the present embodiment, the power unit is set to be a pump 6 which is arranged on a liquid pumping flow channel 8 at which the liquid storage cavity 4 is communicated with the water supply path 1, to provide liquid inside the liquid pumping flow channel 8 with a driving force flowing from the liquid storage cavity 4 to the direction of the water supply path 1. In the present embodiment of the present disclosure, the liquid pumping flow channel 8 is also integrated inside the upper cover 3, an inlet 81 of the liquid pumping flow channel 8 is communicated with the liquid storage cavity 4 through a communicating vessel 7, an outlet 82 of the liquid pumping flow channel 8 is communicated with an inlet of the pump 6, and the outlet of the pump 6 is communicated with a liquid suction opening 13 arranged on the water supply path 1. Through controlling operating and suspending of the pump 6, an object of pumping additives in the liquid storage cavity 4 to the water supply path 1 for delivering is achieved.

In the present embodiment, the power unit can also be provided with other existing structure, for example, the power unit can be a suction pump, a suction opening of the suction pump is communicated with the water supply path 1, such that a negative pressure is formed in the water supply path 1, and additives in the liquid storage cavity 4 is pumped to the water supply path 1 via a liquid pumping flow channel 8;

and/or, the power unit can also be a Venturi tube arranged on the water supply path 1, the Venturi tube is provided with a negative pressure area with a sudden change in tube diameters, the negative pressure area can form a negative pressure herein by utilizing water flow which flows through, the negative pressure area of the Venturi tube is provided with a suction opening, and the suction opening is communicated with the liquid storage cavity 4 via the liquid pumping flow channel 8 (not indicated in the accompanying drawings).

In the present embodiment, the additive delivery apparatus 100 includes a plurality of liquid storage cavities 4, each liquid storage cavity 4 can respectively accommodate different types of additives, such as detergent, softener, perfuming agent, disinfector, etc.; the delivery apparatus 100 is provided with a control device, and the control device is configured to control one or a combination of each liquid storage cavity 4 to be communicated with the water supply path 1, to deliver any additive to the water supply path 1 or deliver a combination of multiple types of additives simultaneously into the water supply path 1.

In the present embodiment, the control device can be set to be any of the existing structures to achieve the above function, for example:

in the present embodiment, each liquid storage cavity 4 is respectively connected with a water supply path 1 via a flow channel provided with a control valve, to achieve an effect of controlling connection and disconnection of each flow channel separately or a combination of flow channels through controlling opening and closing of each control valve, to further achieve an object of independently delivering any type of additives or simultaneously delivering multiple types of additives.

Each liquid storage cavity 4 can also be communicated with different inlets of a same reversing valve in a one-to-one correspondence manner, an outlet of the reversing valve is communicated with a water supply path 1, the reversing valve is internally provided with a rotatable valve element, to control connection between any one inlet or a combination of inlets and an outlet, and meanwhile, an object that any type of additives is delivered independently or multiple types of additives are delivered simultaneously is achieved (not indicated in the accompanying drawings).

As shown in FIG. 1 to FIG. 8, in the present embodiment, the shell 2 of the delivery apparatus 100 is internally provided with a liquid storage box 5, the liquid storage box 5 can be installed in the shell 2 of the additive delivery apparatus 100 in a manner of capable of being pulled outwards. The liquid storage box 5 is internally provided with at least one liquid storage cavity 4 to store additives, each liquid storage cavity 4 on the liquid storage box 5 is communicated with the water supply path 1 via a communicating vessel 7, and the communicating vessel 7 is provided with a control device, to control connection of any or a combination of liquid storage cavities 4 with the water supply path 1 with controllable connection and disconnection.

In the present embodiment, the inlet 12 of the water supply path 1 is arranged on an outer wall of the shell 2, and the inlet 12 of the water supply path 1 is connected with a water supply source, such that water inlet flow can flow into the water supply path 1.

In the present embodiment, the additive delivery apparatus 100 is installed on a washing machine, and a water supply source of the additive delivery apparatus is a water inlet pipe of a washing machine. An inlet 12 of the water supply path 1 is connected with the water inlet pipe of the washing machine, such that inlet washing water can flow into the water supply path 1 via the inlet 12. The shell 2 of the additive delivery apparatus 100 is provided with a water inlet connector, two ends of the water inlet connector are respectively communicated with an inlet 12 of the water supply path 1 and a water inlet pipe of a washing machine; and further preferably, a control valve configured to control connection and disconnection of a water path is installed at the water inlet connector.

In the present disclosure, through the above additive delivery apparatus 100 arranged on the washing machine, additives of a washing machine directly flow to a nozzle 500 via a water supply path 1 and are directly sprayed into the washing drum 300 from the nozzle 500, and further additives in the washing machine directly flow into the washing drum 300 from a water path of the delivery apparatus 100 and are sprayed to the loads to be treated without flowing through the water box and without flowing through a water accommodating drum 200 outside the washing drum 300, thereby further achieving an object that additive solution is directly sprayed onto loads to be treated in the washing drum 300. Meanwhile, through the above setting, in the washing machine installed with the above additive delivery apparatus 100, an additive solution formed when additives are mixed with a small amount of inlet water in the water supply path 1 is directly sprayed onto the loads to be treated in the washing drum 300, and further the utilization rate of delivered additives is dramatically improved.

Figure 6:
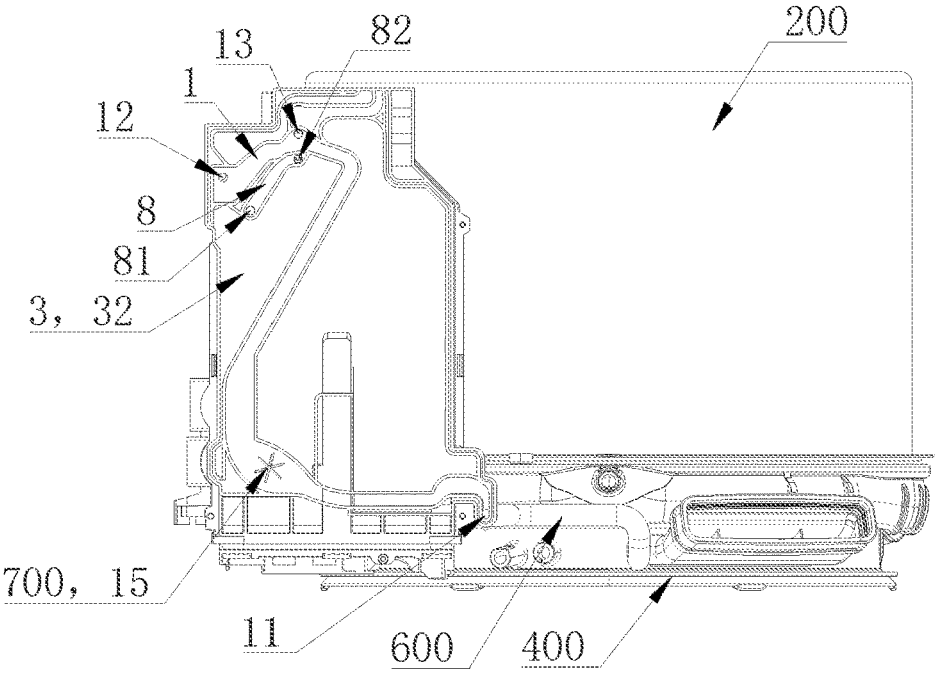
FIG. 6 is a structural schematic diagram of a top view of a washing machine after a first part of an upper cover is removed in embodiments of the present disclosure.

As shown in FIG. 6 to FIG. 8, in the present embodiment, a liquid suction opening 13 is formed in the middle of the water supply path 1, the liquid suction opening 13 is communicated with the delivery structure, such that additives are pumped into the water supply path 1 from the liquid suction opening 13. Preferably, the liquid suction opening 13 is communicated with an outlet of the pump 6, the outlet of the pump 6 is communicated with an outlet 82 of the liquid pumping flow channel 8, an inlet 81 of the liquid pumping flow channel 8 is communicated with an outlet of the communicating vessel 7, and a plurality of inlets of the communicating vessel 7 are connected with each liquid storage cavity 4 in a one-to-one correspondence manner, to achieve an object that additives in the liquid storage cavity 4 are pumped into the water supply path 1 via the above flow channel under a driving effect of the pump 6.

As shown in FIG. 6, in the present embodiment, the water supply path 1 downstream of the liquid suction opening 13 can mix additives and inlet water flowing to the water supply path 1 to form an additive solution. Preferably, the liquid suction opening 13 is arranged to be adjacent to an inlet 12 of the water supply path 1, to extend the length of the water supply path 1 downstream of the liquid suction opening 13 as much as possible, such that part of the downstream space of the water supply path 1 allowing mixing of additives and water is enlarged, and further mixing uniformity between additives and inlet water is increased.

In the present embodiment, the nozzle 500 can be arranged on the shell, and/or door body, and/or water accommodating drum 200, and/or window pad 400 of a washing machine, the spray outlet of the nozzle 500 is formed towards the inside of the washing drum 300, and additives sprayed out by the nozzle 500 are directly sprayed into the inside of the washing drum 300.

Preferably, in the present embodiment, the nozzle 500 can be specifically installed as follows:

as shown in FIG. 1 to FIG. 8, a circle of window pad 400 is installed at an opening of the water accommodating drum 200, the window pad 400 is cylindrical, and one end of the cylindrical window pad 400 is connected with the opening of the water accommodating drum 200 and the other end is connected with the shell of the washing machine, to form a channel. The opening of the washing drum 300 is relatively communicated with one end of the above channel, the shell of the washing machine is provided with a clothes delivery opening correspondingly communicated with another end of the above channel, the shell of the washing machine is installed with a door body which can correspondingly open and close a clothes delivery opening, and after the door body is enclosed, an enclosed space is formed inside the water accommodating drum 200. A clearance space exists between the door body and the window pad 400, and the clearance space is directly communicated with the inside of the washing drum 300 via an opening of the washing drum 300. The nozzle 500 is installed on the top of the window pad 400, the nozzle 500 penetrates through the window pad 400, part of the nozzle 500 arranged on the inner circumferential side of the window pad 400 is provided with a spray outlet, part of the nozzle 500 arranged on the outer circumferential side of the window pad 400 is provided with an inlet, a flow channel is arranged in the nozzle 500, two ends of the flow channel are respectively connected with the inlet and the spray outlet, the spray outlet is arranged towards the opening of the washing drum 300, such that the additive solution sprayed from the nozzle 500 can be directly sprayed into the washing drum 300, to achieve a notable technical progress that additives are directly sprayed onto loads to be treated in the washing drum 300 and the efficiency of delivering additives is improved.

In the present embodiment, the nozzle 500 can be any existing spray structure, and the spray outlet can be set to be multiple spray holes distributed at intervals and may also be set to be a single opening.

In the present embodiment, the washing machine is internally provided with an independently arranged conduit 600 which is arranged outside the shell of the additive delivery apparatus 100 and outside the water accommodating drum 200, two ends of the conduit 600 are respectively communicated with an inlet of the nozzle 500 and an outlet 11 of the water supply path 1 in an inserting manner, such that an additive solution supplied by the water supply path 1 can be directly guided to the nozzle 500 through the conduit 600, to achieve an effect of directly spraying and delivering additives into the washing drum 300 of the washing machine. Preferably, the above conduit 600 is made of rubber and other materials, and can be bent and deformed.

The above are merely preferred embodiments of the present disclosure, and are not intended to limit the present disclosure in any form. Although the present disclosure has been disclosed as above in the preferred embodiments, the preferred embodiments are not intended to limit the present disclosure. Those skilled in the art, without departing from the scope of the technical solution of the present disclosure, may make minor changes or modifications to equivalent modifications while utilizing the technical contents suggested above, however, any simple modifications, equivalent changes and modifications made to the above embodiments which are not departed from the technical solutions of the present disclosure still fall within the scope of the present disclosure

The invention claimed is:

1. A method for delivering additives to a washing machine, wherein after an inlet water flow and delivered additives are mixed in a water supply path, a mixture is directly sprayed into a rotating washing drum, wherein, specific steps of the additive delivery process are as follows:

step S1, delivering additives to the water supply path, until the delivery amount reaches a preset amount;

step S2, feeding water into the water supply path;

step S3, mixing inlet water and the additives in the water supply path to form a mixture; and step S4, directly spraying the mixture into the washing drum, with the washing drum simultaneously rotating around an axis, wherein, in the process of delivering additives, water flow flows in the water supply path specifically as follows:

step S11, within the first set time t1, feeding water at a first set hydraulic pressure p1;

step S12, within the second set time t2, feeding water at a second set hydraulic pressure p2;

step S13, within the third set time t3, feeding water at a third set hydraulic pressure p3;

wherein p1 is greater than p2, p3 is greater than p2; and t1 is greater than t2, and t3 is greater than t2.

2. The method for delivering additives to the washing machine according to claim 1, wherein, when step S2 is executed, water is fed into the water supply path through the following specific forms:

step S21, first feeding water into the water supply path continuously for a second set time t2, executing step S3 by utilizing inlet water this time to mix the additives in the water supply path, to form an additive mixture; and step S22, feeding water into the water supply path continuously for a third set time t3, to flush out the additive mixture in the water supply path;

before step S1 is executed, water is fed into the water supply path continuously for a first set time t1, to flush the water supply path.

3. The method for delivering additives to the washing machine according to claim 1, wherein, when step S2 is executed, water flow flowing in the water supply path operates alternatively through the following steps:

step S121, within a first set time period t21, closing a water inlet of the water supply path, wherein inlet water flow no longer flows through the water supply path; and step S122, within a second set time period t22, opening the water inlet of the water supply path, wherein inlet water flow flows through the water supply path.

4. The method for delivering additives to the washing machine according to claim 1, wherein the process of delivering additives is divided into a plurality of delivery units, and each delivery unit is executed in sequence according to the above step S1 to step S4; a spacing time between adjacent delivery units is T2, a total time for each delivery unit to execute step S1 to step S4 is T1, T2 is not less than T1.

5. The method for delivering additives to the washing machine according to claim 1, wherein, when step S3 is executed, a stirring motor in the water supply path drives a stirring impeller to rotate, to stir a mixture of inlet water the additives which flow through.

6. The method for delivering additives to the washing machine according to claim 1, wherein when step S2 to step S4 are executed, the mixture is sprayed into the washing drum from an opening of the washing drum, and the washing drum rotates at a set rotating speed V1; when step S3 is executed, the washing drum rotates at a first set rotating speed V11; when step S4 is executed, the washing drum rotates at a second set rotating speed V12; V12 is greater than or equal to V11.

7. The method for delivering additives to the washing machine according to claim 4, wherein within the spacing time T2, the washing drum rotates around an axis at a set rotating speed V2; and in each delivery unit, a delivery amount of additives is not greater than a maximum set amount M.

8. The method for delivering additives to the washing machine according to claim 2, wherein the process of delivering additives is divided into a plurality of delivery units, and each delivery unit is executed in sequence according to the above step S1 to step S4; a spacing time between adjacent delivery units is T2, a total time for each delivery unit to execute step S1 to step S4 is T1, T2 is not less than T1.

9. The method for delivering additives to the washing machine according to claim 2, wherein, when step S3 is executed, a stirring motor in the water supply path drives a stirring impeller to rotate, to stir a mixture of inlet water the additives which flow through.

10. The method for delivering additives to the washing machine according to claim 6, wherein before step S1 is executed and at the first set time t1 at which water is fed into the water supply path, the washing drum rotates at the set rotating speed V2, and V2 is greater than V11.

11. The method for delivering additives to the washing machine according to claim 2, wherein when step S2 to step S4 are executed, the mixture is sprayed into the washing drum from an opening of the washing drum, and the washing drum rotates at a set rotating speed V1; when step S3 is executed, the washing drum rotates at a first set rotating speed V11; when step S4 is executed, the washing drum rotates at a second set rotating speed V12; V12 is greater than or equal to V11.

* * * * *